US005503609A

United States Patent [19]

Bull

[11] Patent Number: 5,503,609

[45] Date of Patent: Apr. 2, 1996

[54] EXERCISING APPARATUS

[76] Inventor: John W. Bull, 2502 Wedgewood Ct., Olympia, Wash. 98501

[21] Appl. No.: 302,211

[22] Filed: Sep. 8, 1994

[51] Int. Cl.[6] ..... A63B 21/00; A63B 23/04

[52] U.S. Cl. ..... 482/70; 482/51

[58] Field of Search ..... 482/70, 51, 71, 482/907, 148, 52, 53

[56] References Cited

U.S. PATENT DOCUMENTS

| | | | |
|---|---|---|---|
| 4,506,884 | 3/1985 | Hankin | 482/907 |
| 4,650,184 | 3/1987 | Brebner | 482/71 |
| 5,295,935 | 3/1994 | Wang | 482/907 |
| 5,328,427 | 7/1994 | Sleamaker | 482/51 |

*Primary Examiner*—Stephen R. Crow
*Attorney, Agent, or Firm*—F. Eugene Logan

[57] ABSTRACT

An exercising apparatus for simulating skating and skiing motion in which outward and opposite unilateral movement of the user's feet ultimately drives a momentum storage member which can be a flywheel. The apparatus has a base for supporting a track having left and right distal ends. The track positions and restrains foot carriages to approximately horizontal movement. The foot carriages support the user's feet so that when the user's left foot extends outwardly and to the left of user's body the left carriage moves towards the left distal end of the track, and when the user's right foot extends outwardly and to the right of user's body the right carriage moves towards the right distal end of the track. A driven pulley is supported by the base and drives the momentum storage member. The apparatus has a first subassembly having unilaterally acting first engaging member and first transmission, and a second subassembly having unilaterally acting second engaging member and second transmission. The first subassembly drives the driven pulley in a drive direction when the left carriage moves towards the left distal end and does not drive the driven pulley when the left carriage moves towards the right distal end. The second subassembly drives the driven pulley in the drive direction when the right carriage moves towards the right distal end and does not drive the driven pulley when the right carriage moves towards the left distal end. The momentum storage member provides resistance to outward movement of the carriages. A variable braking force can be applied to the momentum storage member.

32 Claims, 16 Drawing Sheets

EXERCISING APPARATUS

BACKGROUND OF THE INVENTION

Exercising apparatus having side to side motion simulating ice skating or skiing are known. For example, U.S. Pat. No. 3,559,986 discloses an exercising apparatus having, in one embodiment, a pair of dollies in FIG. 2 disposed on a single track for outward and inward movement along the track. U.S. Pat. No. 4,340,214 discloses an exercising apparatus having left and right carriages which travel on abutted tracks. A foot plate is pivotally mounted on each carriage. Each foot plate rolls up a slight incline as the carriage moves outward along the track.

U.S. Pat. No. 5,217,420 also discloses an exercising apparatus having, in one embodiment, foot members with roller mounted on the same track for side to side movement. U.S. Pat. No. 5,279,532 discloses an exercising apparatus having an elastic band connected to a pair of sliding side to side foot pedals which roll along a track. The Netherlands No. 8,800,677 also discloses an exercising apparatus having foot rest supported on parallel guide tubes for side to side movement. A pretensioned cord appears to require the foot rest to move in tandem-like manner.

Soviet Union No. 1,500,326 discloses an exercising apparatus having cables connected to carriages that travel left and right on a straight guide which can also rotate to simulate turning on skis.

U.S. Pat. No. 2,455,274 discloses an exercising apparatus having a tension spring for resisting separation of shoe plates in side to side movement.

A skating exercising apparatus is disclosed in U.S. Pat. No. 4,915,373 having two separated, endless triangular tracks for simulating ice skating.

U.S. Pat. No. 5,284,460 discloses an exercising apparatus having long foot levers. The device has sprockets, mounted one above the other, which are ratcheted on a single shaft, and a resistance mechanism. A spring causes return of a skating arm by acting through a chain.

Another skating exercising apparatus having long levers is disclosed in U.S. Pat. No. 4,795,146 with lever-mounted foot pads that pivot outwardly against a spring resistance.

An exercising apparatus intended to simulate cross-country skiing is disclosed in U.S. Pat. No. 3,475,021 which has two skis pivotally mounted on a frame for simulating front to back motion and sideward pushing motion. Soviet Union No. 1,708,370 discloses an exercising apparatus having two parallel tracks each with a foot platform connected by cord to over-running clutches. The foot platform provide front to back movement for simulate cross-country skiing.

U.S. Pat. No. 3,941,377 discloses a treadmill-like device having foot plates connected to a belt having teeth that slip over corresponding teeth on a cylindrical body when the belt is pushed to the rear.

An exercising apparatus for simulating turning on downhill skiing is disclosed in U.S. Pat. No. 3,791,645 which has a single carriage which can roll on a pair of parallel rails. The carriage supports both feet of the user and is tilted at various angles by a motorized mechanism to simulate turning.

U.S. Pat. No. 3,834,693 also discloses an exercising apparatus having foot platforms capable of side to side movement and front to back movement to simulate turning on skis.

Other exercising apparatus for simulating ice skating and skiing exercising apparatus are disclosed in U.S. Pat. Nos. 3,475,021; 3,756,595; 4,396,189; 4,781,372; 4,811,941 and 4,911,430, and Weider leaflet entitled A-Robic Skatemaster which appears to have pivotally mounted foot levers.

None of these exercising apparatus appears capable of providing a system that can simulate ice skate racing that requires a continuous, repetitive, smooth flow of energy into the system by outward thrust of the user's legs.

SUMMARY OF THE INVENTION

The present invention is directed towards a new, improved, relatively simple and inexpensive exercising apparatus which is particularly well suited for training, strengthening and rehabilitating skaters, skiers and other athletes that can be used indoors or outside. The exercising apparatus requires relatively little maintenance and its parts can be easily and quickly replaced. The exercising apparatus requires little space for storage, and for some embodiments, it can be stored under a bed.

Sporting events such as speed skating both ice and roller, in-line skating, ice hockey and cross-country skiing require high levels of endurance which can generally only be obtained by continuous practice of the sport. In many countries snow and ice skating rinks are not always accessible and travel is necessary to reach sites adequate equipped for such practice. Thus an exercising apparatus which can substitute for an ice rink or ski trail, and also provide an inexpensive means of practice and training is very desirable. However, to be most effective the exercising apparatus must provide a system that can simulate speed skating and cross-country ski racing by requiring a continuous, dynamic, repetitive, smooth flow of energy from the athlete to the exercising apparatus by outward thrust to the user's left and right side of the user's legs at both high, medium and low speeds. This invention solves to a large extent the above-mentioned needs and is especially useful for speed skaters and the new climbing motion now used by cross-country skiers. This invention can also be used by other of less athletic ability for aerobic and anaerobic exercise for strengthening cardiovascular systems and for improving leg and hip strength or rehabilitating of a leg or hip injury.

Accordingly, there is provided by the principles of this invention an exercising apparatus in which outward and approximately opposite unilateral movement of the user's feet drives driven means in a drive direction. The exercising apparatus comprises base means for supporting track means having left and right distal ends. The exercising apparatus also comprises left carriage means and right carriage means for supporting user's left foot and right foot, respectively, and driven means, supported by the base means, for driving resistance means.

In operation, when the user's left foot extends outwardly and to the left of user's body the left carriage means moves towards the left distal end of the track means, and when the user's right foot extends outwardly and to the right of user's body the right carriage means moves towards the right distal end of the track means. In general, the track means restrains the left and the right carriage means to approximately horizontal movement.

The apparatus also comprises first means having unilaterally acting first engaging means and first transmission means. The first means being operable for effecting the driving of the driven means in a drive direction when the left carriage means moves towards the left distal end and not driving the driven means when the left carriage means moves towards the right distal end. Similarly, there is corresponding second means having unilaterally acting second engaging means and second transmission means. The second means being operable for effecting the driving of the driven means in the drive direction when the right carriage means moves towards the right distal end and not driving the driven means when the right carriage means moves towards the left distal end. The driven means is for driving resistance means which is for resisting the outward movement of the left and right carriage means. In one embodiment, the driven means also serves as the resistance means, and in such embodiment the driven means is for resisting the outward movement of the left and right carriage means.

In one embodiment of this invention, the track means is operable for preventing the left and right carriage means from passing each other so that the left carriage means is always to the left of the right carriage means. In a further embodiment, the left side of the right carriage means can touch the right side of the left carriage means as the left and right carriage means moves on the track means. Preventing the touching or bumping of one carriage means into other carriage means requires an increased skill level by the user thereby simulating a higher skill level in ice skating and skiing.

In another embodiment, the left and right carriage means are also operable for positioning the user's feet approximately horizontal and approximately perpendicular to the track means.

By the expression "approximately horizontal" to the track means as used herein is meant, that angles 65,66 and 67 shown in FIGS. 3 and 6 are between 0° and about 15°. By the expression "approximately perpendicular" to the track means as used herein is meant, that angles 63 and 64 shown in FIG. 2 are between about 0° and about 30°.

In a further embodiment, the apparatus comprises means for assisting in the return of the left carriage means to the right distal end of the track means, and means for assisting in the return of the right carriage means to the left distal end of the track means.

In one embodiment, the driven means comprises a pulley. In another embodiment, the driven means comprises common shaft means upon which the first and second engaging means are mounted. In another embodiment, the first and second engaging means are mounted on shaft means which is supported by the base means.

In another embodiment, the left carriage means drives a first flexible member which drives the first engaging means which drives the driven means, and the right carriage means drives a second flexible member which drives the second engaging means which drives the driven means.

In one embodiment, the first transmission means is also the second transmission means, and in a further embodiment, the first transmission means comprises a flexible member.

In another embodiment, the first engaging means is supported by the left carriage means and the second engaging means is supported by the right carriage means. In a further embodiment, the first and second engaging means drive first and second flexible members, respectively, each of which independently drives the driven means. In a still further embodiment, the first flexible member also serves as the second flexible member.

In one embodiment, the first and second engaging means each comprise a pulley/clutch having a gear pulley, and the flexible member comprises teeth adapted for meshing with the gear pulleys.

There is also provided by the principles of this invention an exercising apparatus in which outward and approximately opposite unilateral movement of the user's feet drives driven means in a drive rotational direction. In this embodiment, the driven means is rotatably supported by the base means.

In this embodiment, the first means comprises unilaterally acting first engaging means and first transmission means. The unilaterally acting first engaging means has a drive rotational direction and an opposite, idle rotational direction, and is for (i) driving the driven means in a drive rotational direction when the first engaging means moves in its drive rotational direction, and (ii) overrunning the driven means when the first engaging means moves in its idle rotational direction. The first transmission means is connected to the left carriage means and is for rotating the first engaging means in its drive rotational direction when the left carriage means moves towards the left distal end.

In this embodiment, the second means comprises unilaterally acting second engaging means and second transmission means. The unilaterally acting second engaging means has a drive rotational direction and an opposite, idle rotational direction, and is for (i) driving the driven means in its drive rotational direction when the second engaging means moves in its drive rotational direction, and (ii) overrunning the driven means when the second engaging means moves in its idle rotational direction. The second transmission means is connected to the right carriage means and is for rotating the second engaging means in its drive rotational direction when the right carriage means moves towards the right distal end. In this embodiment, the resistance means is for resisting the rotation of the driven means and hence outward movement of the left and right carriage means.

In one embodiment, the first transmission means comprises a first flexible member and first idler means, and the first flexible member forms a linkage between the left carriage means, the first idler means, and the first engaging means. In this embodiment the second transmission means comprises a second flexible member and second idler means, and the second flexible member forms a linkage between the right carriage means, the second idler means, and the second engaging means.

In a further embodiment, the resistance means comprises rotational momentum storage means for storing rotational momentum, flexible transmission means for forming a continuous loop between the driven means and the rotational momentum storage means so that rotation of the driven means in its drive rotational direction causes rotation of the rotational momentum storage means, and braking means for resisting rotation of the rotational momentum storage means.

There is also provided by the principles of this invention an exercising apparatus having unilaterally acting first engaging means, supported by the left carriage means, for engaging and driving first transmission means when the left carriage means moves towards the left distal end, and overrunning and not driving the first transmission means when the left carriage means moves towards the right distal end. This embodiment also provides unilaterally acting second engaging means, supported by the right carriage means, for engaging the second transmission means when the right carriage means moves towards the right distal end, and overrunning the second transmission means when the right carriage means moves towards the left distal end. In a further embodiment, the first and second transmission means comprise flexible members. In a still further embodiment, the first flexible member also serves as the second flexible member, and the flexible member forms a continuous loop between the first engaging means, the second engaging means, and the driven means.

The first engaging means is for (i) engaging and driving the first flexible member in a first flexible member drive direction and (ii) overrunning or not driving the first flexible member when the left carriage means moves toward the right distal end. Similarly, the second engaging means is for (i) engaging and driving the second flexible member in the first flexible member drive direction when the right carriage means moves towards the right distal end, and (ii) overrunning or not driving the second flexible member when the right carriage means moves toward the left distal end. As mentioned above, the first flexible member can also serves as the second flexible member, and the flexible member then forms a continuous loop between the first engaging means, the second engaging means, and the driven means.

In a further embodiment, the first engaging means comprises a first pulley/clutch rotatably mounted on first shaft means which is supported by the left carriage means, and the first pulley/clutch engages the first flexible member by locking onto it. Similarly, the second engaging means comprises a second pulley/clutch mounted on second shaft means which is supported by the right carriage means, and the second pulley/clutch engages the second flexible member by also locking onto it.

In another further embodiment, the first engaging means comprises a first pawl pivotally mounted on and supported by the left carriage means, and the first pawl engages the first flexible member by locking onto it. Similarly, the second engaging means comprises a second pawl pivotally mounted on and supported by the right carriage means, and the second pawl engages the second flexible member by locking onto it. In a still further embodiment, the first flexible member can also serve as the second flexible member.

DESCRIPTION OF THE PREFERRED EMBODIMENTS

With reference to the drawings, like element numbers are used to designate like parts where specific independent designation is not necessary.

Figure 1:
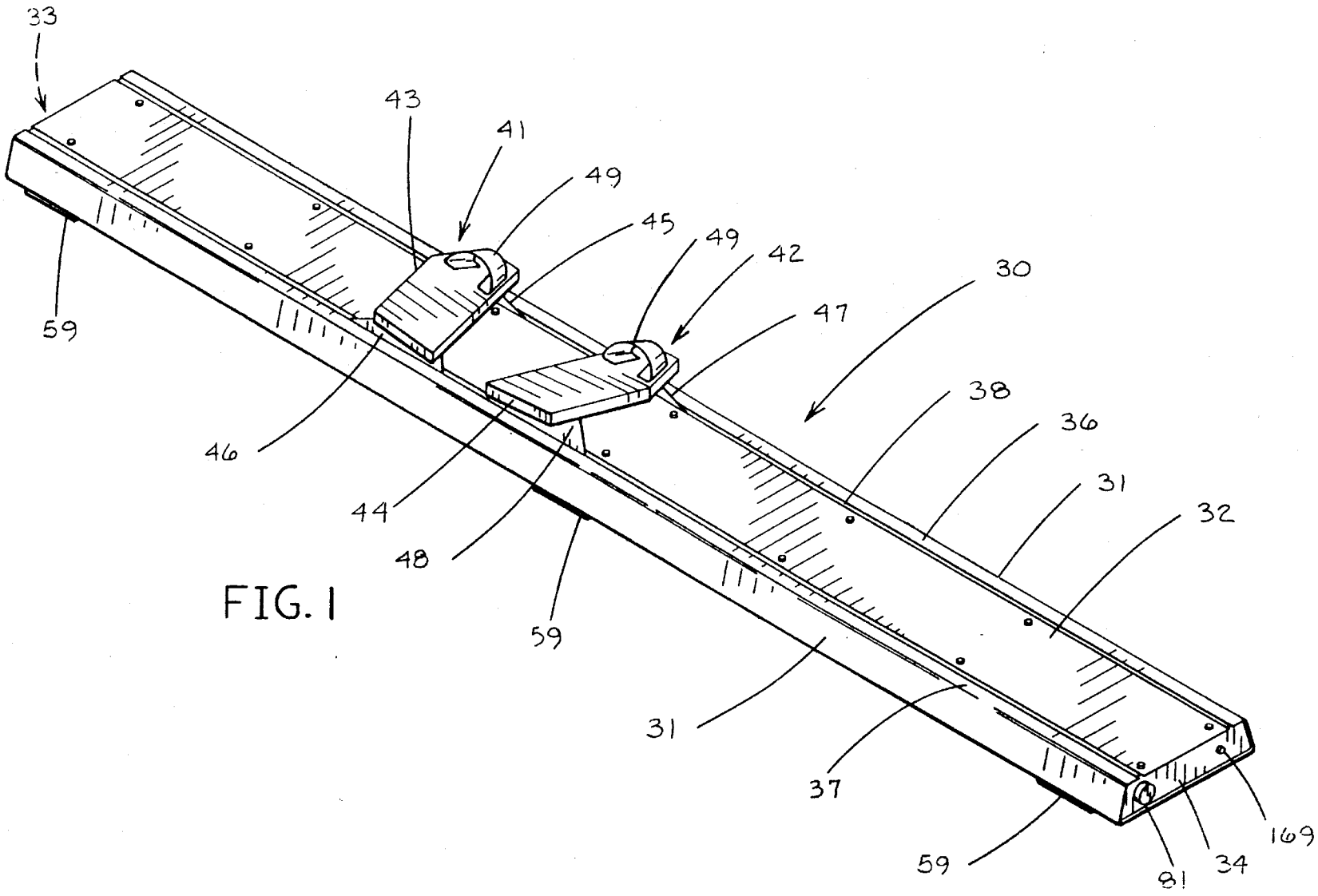
FIG. 1 is perspective view of an exercising apparatus of this invention.
Figure 6:
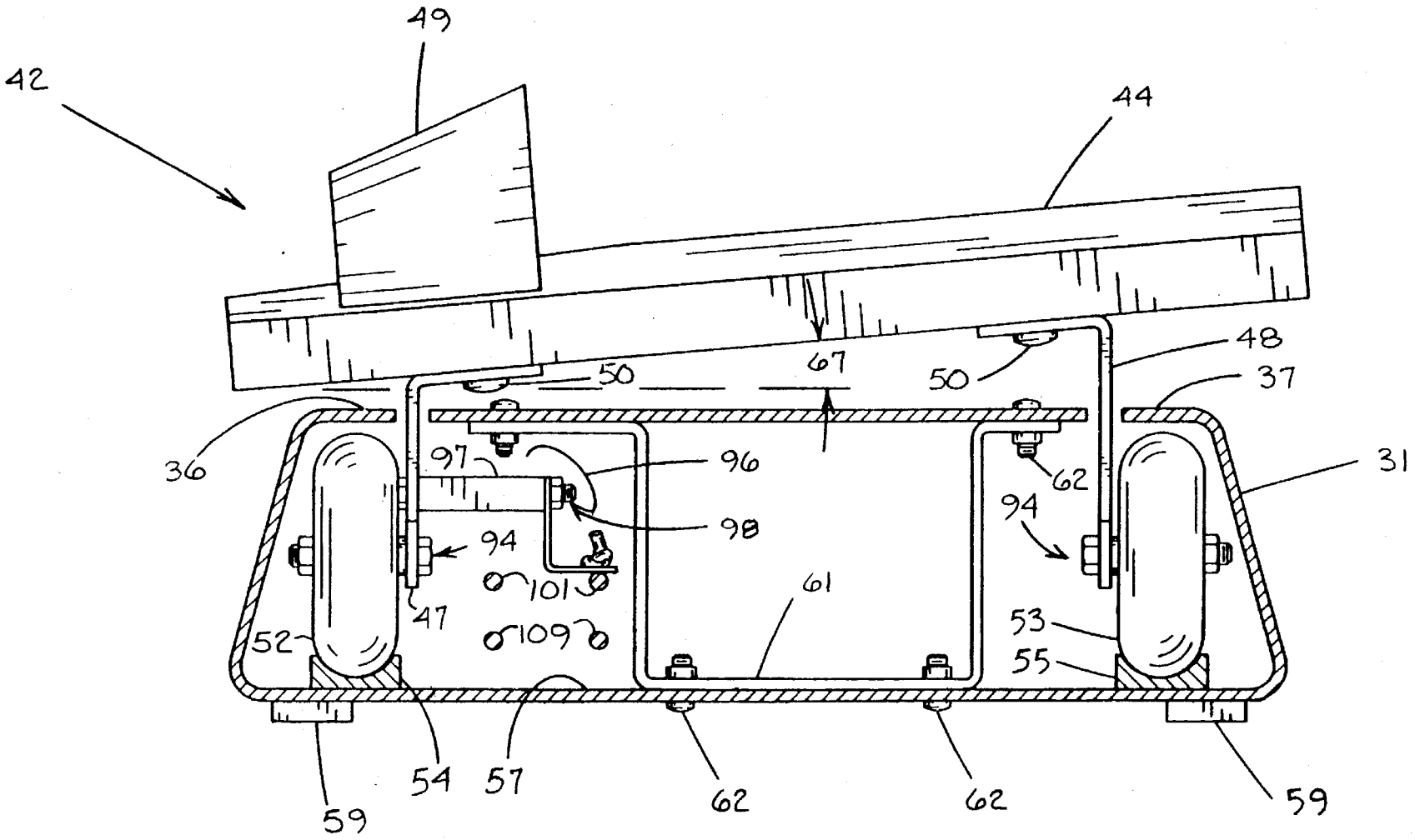
FIG. 6 is cross-sectional view taken through line 6—6 of FIG. 2.

FIG. 1 is a perspective view of an embodiment of this invention generally designated by 30 showing an exercising apparatus having an outer housing 31, top plate 32, and left and right end plates 33 and 34, respectively. FIGS. 2, 3, 4 and 5 are top, rear, and left end, and bottom views of the exercising apparatus of FIG. 1. The front and rear upper lip portions 36 and 37 of outer housing 31 with top plate 32 form front and rear parallel elongated slots 38 and 39 shown best in FIG. 4. Left and right carriage means 41 and 42 containing left and right foot platforms 43 and 44 supported by wheel brackets 45 and 46, and 47 and 48, respectively, and attached thereto by fastener means 50, shown best in FIGS. 4 and 6. FIG. 6 shows the support mechanism for right foot platform 44; the left foot platform 43 being supported in a corresponding manner. Preferably foot platforms 43 and 44 contain toe straps 49. Attached to the lower end of wheel brackets 45, 46, 47 and 48 are front and rear wheels 52 and 53, respectively, which ride in, and are at least partly constrained by, parallel front and rear tracks 54 and 55, respectively, which are supported by the bottom inside surface 57 of outer housing 31 and bonded thereto by epoxy adhesive. The outer bottom surface of outer housing 31 contain a plurality of feet 59 preferably made of a resilient non-skid material such as rubber. Top plate 32 is supported by U-brace 61 which rest on the bottom inside surface 57 of outer housing 31, is secured by a plurality of fastener means 62. When the exercising apparatus 30 is placed on a horizontal surface, tracks 54 and 55 will lie in an approximate horizontal plane. In general the by term "the track" is meant tracks 54 and 55. In general, unless otherwise specified, the normal orientation of the exercising apparatus 30 is such that the plane through the track is nominally horizontal, and the term "horizontal" shall mean the plane through the track, and the term "vertical" shall mean the plane perpendicular to the plane through the track.

Figure 2:
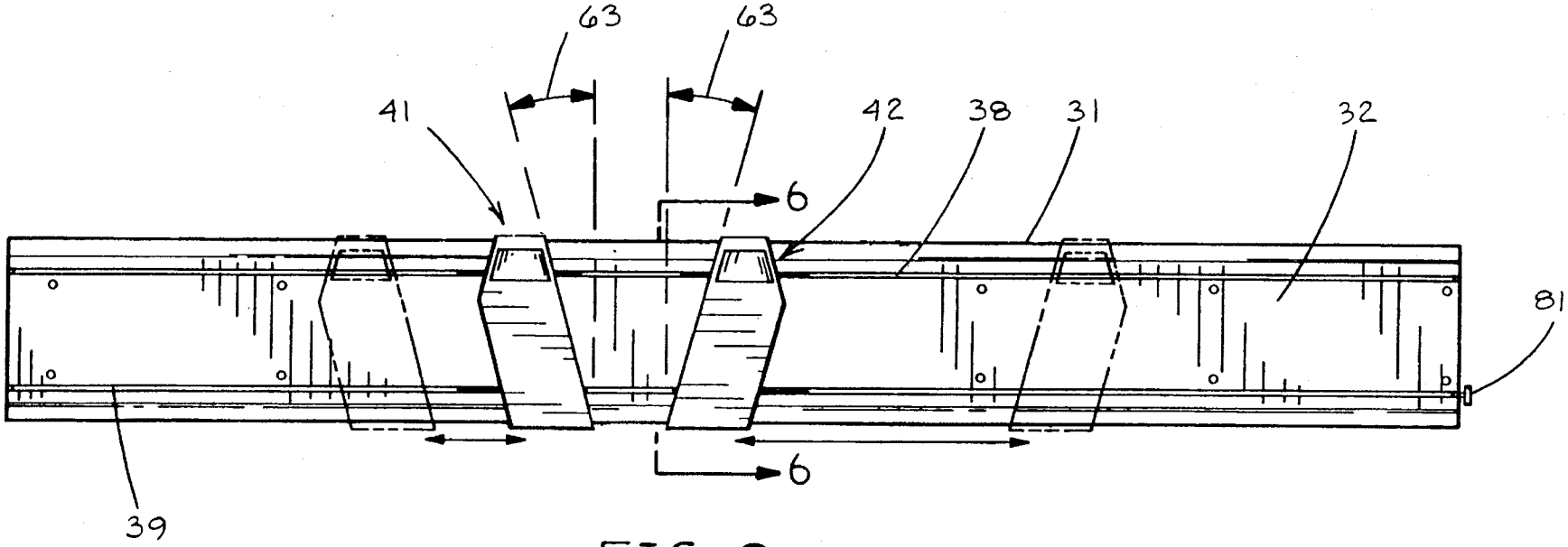
FIG. 2 is a top plan view of the exercising apparatus of FIG. 1.
Figure 3:
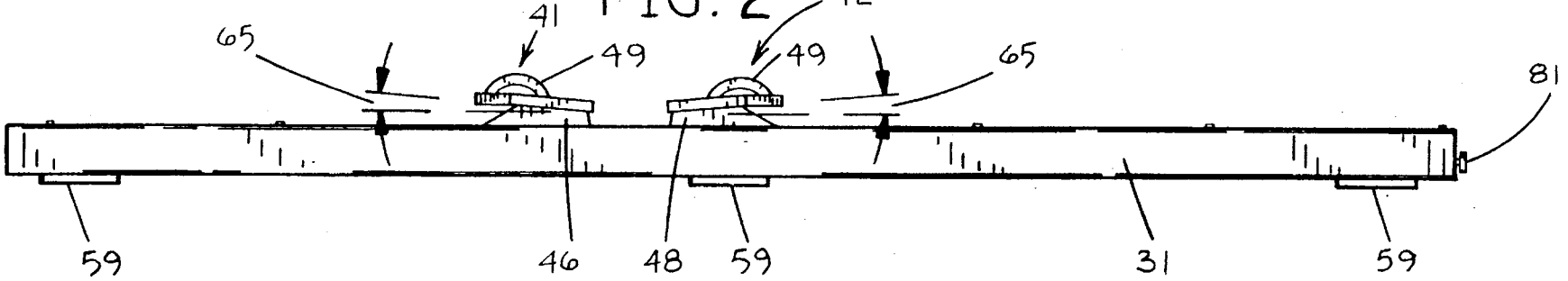
FIG. 3 is a rear elevation view of the exercising apparatus of FIG. 1.
Figure 4:
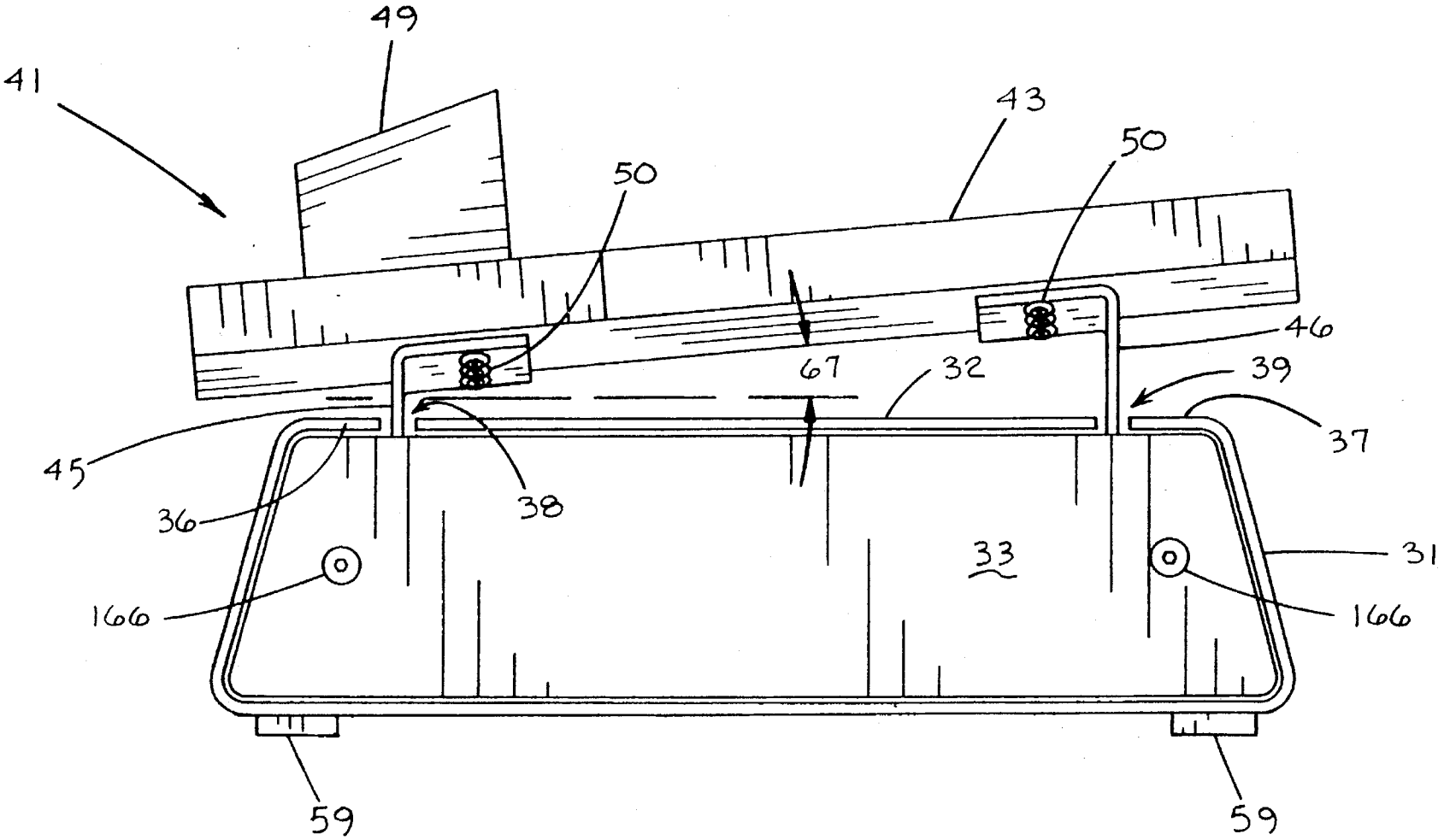
FIG. 4 is right side end view of the exercising apparatus of FIG. 1.
Figure 5:
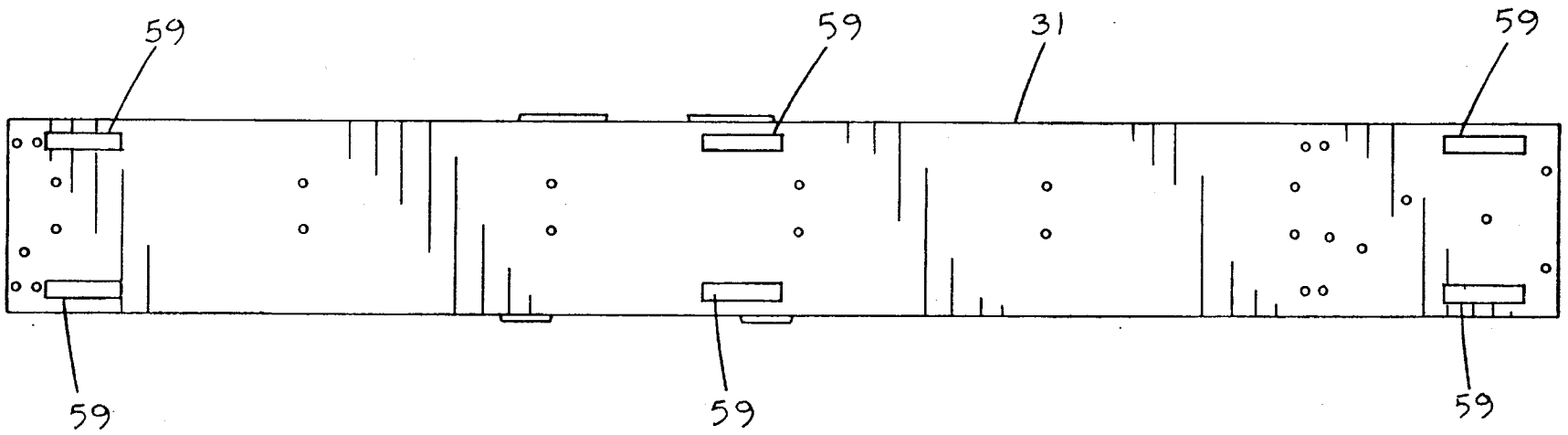
FIG. 5 is a bottom plan view of the exercising apparatus of FIG. 1.

As seen by FIG. 2 foot platforms 43 and 44 are approximately perpendicular, but preferably not exactly perpendicular, to elongated slots 38 and 39 and the track. In this embodiment foot platforms 43 and 44 are oriented about 15° from the perpendicular to the track with the left foot platform angle 63 being counter-clockwise from the norm to the track and the right foot platform angle 64 being clockwise from the norm to the track as shown in FIG. 2. Foot platforms 43 and 44 are also approximately horizontal, but preferably not exactly horizontal. As shown in FIG. 3, foot platforms 43 and 44 are also oriented about 5° from the horizontal with the left foot platform angle 65 being clockwise from the horizontal in elevation, and the right foot platform angle 66 being counter-clockwise from the horizontal in elevation. As shown in FIGS. 4 and 6, foot platforms 43 and 44 are also preferably tipped downward from back to front about 5° from the horizontal as shown by angle 67. This three dimensional deviation from the horizontal and vertical planes is more comfortable for most users than an orientation which is exactly horizontal and exactly vertical. Other angles can of course be used, and in another embodiment, wheel brackets 45, 46, 47 and 48 are adjustable in a conventional manner so orientation angles 63, 64, 65, 66 and 67 can be adjusted to the angle that the particular user finds most comfortable.

Figures 7, 8, 9:
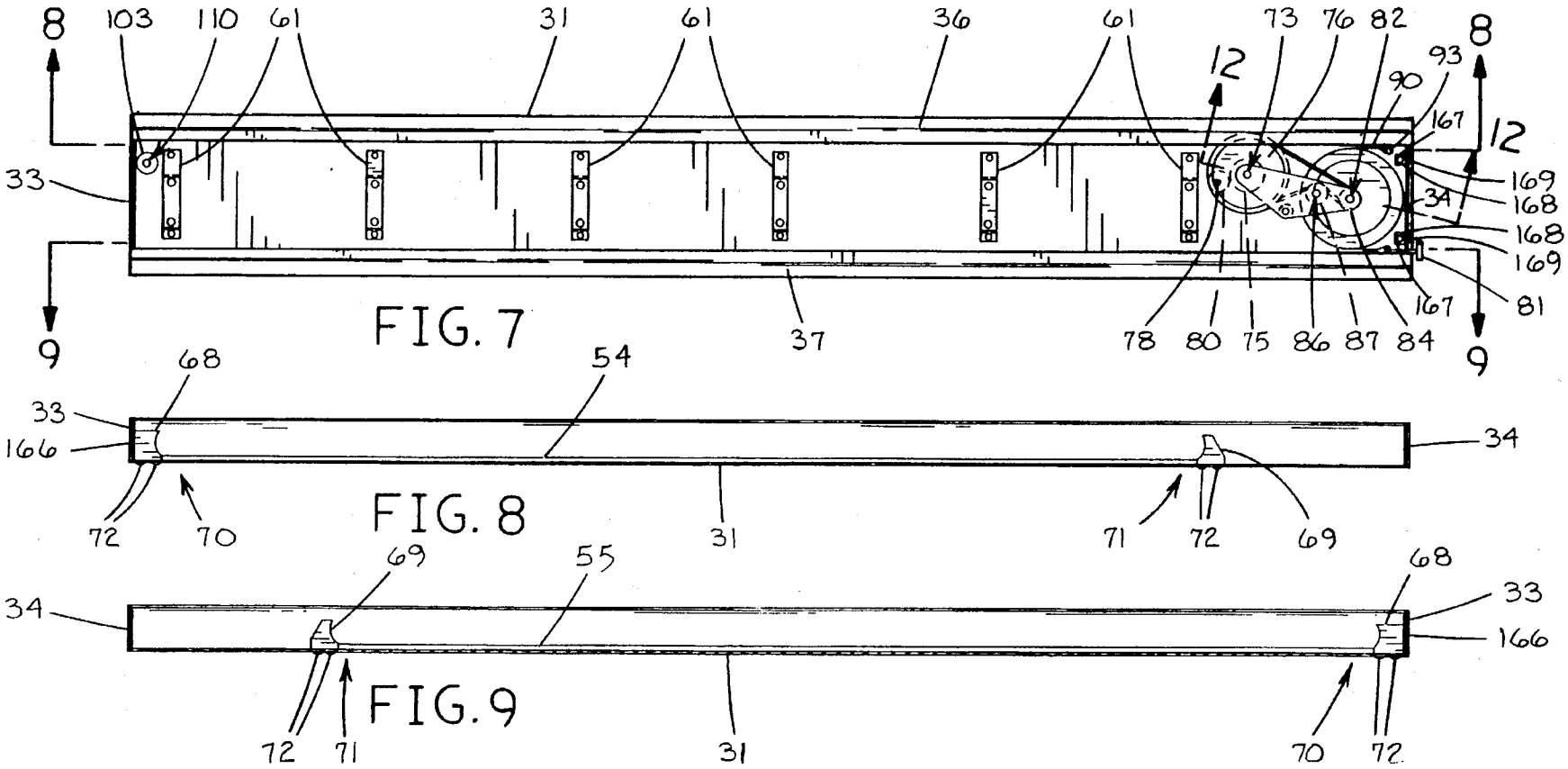
FIG. 7 is the exercising apparatus of FIG. 1 with the top plate, the left and right carriage means, and feet 59 removed.
FIG. 8 is cross-sectional view taken through line 8—8 of FIG. 7.
FIG. 9 is cross-sectional view taken through line 9—9 of FIG. 7

FIGS. 7, 8 and 9 show the exercising apparatus of FIG. 1 with the top plate 32, the left and right carriage means 41 and 42, and feet 59 removed. FIG. 7 shows six spaced apart U-braces 61, front and rear tracks 54 and 55 with left and right carriage stops 68 and 69, respectively, on the track at the left and right distal ends 70 and 71, respectively, thereof.

Figures 10, 13:
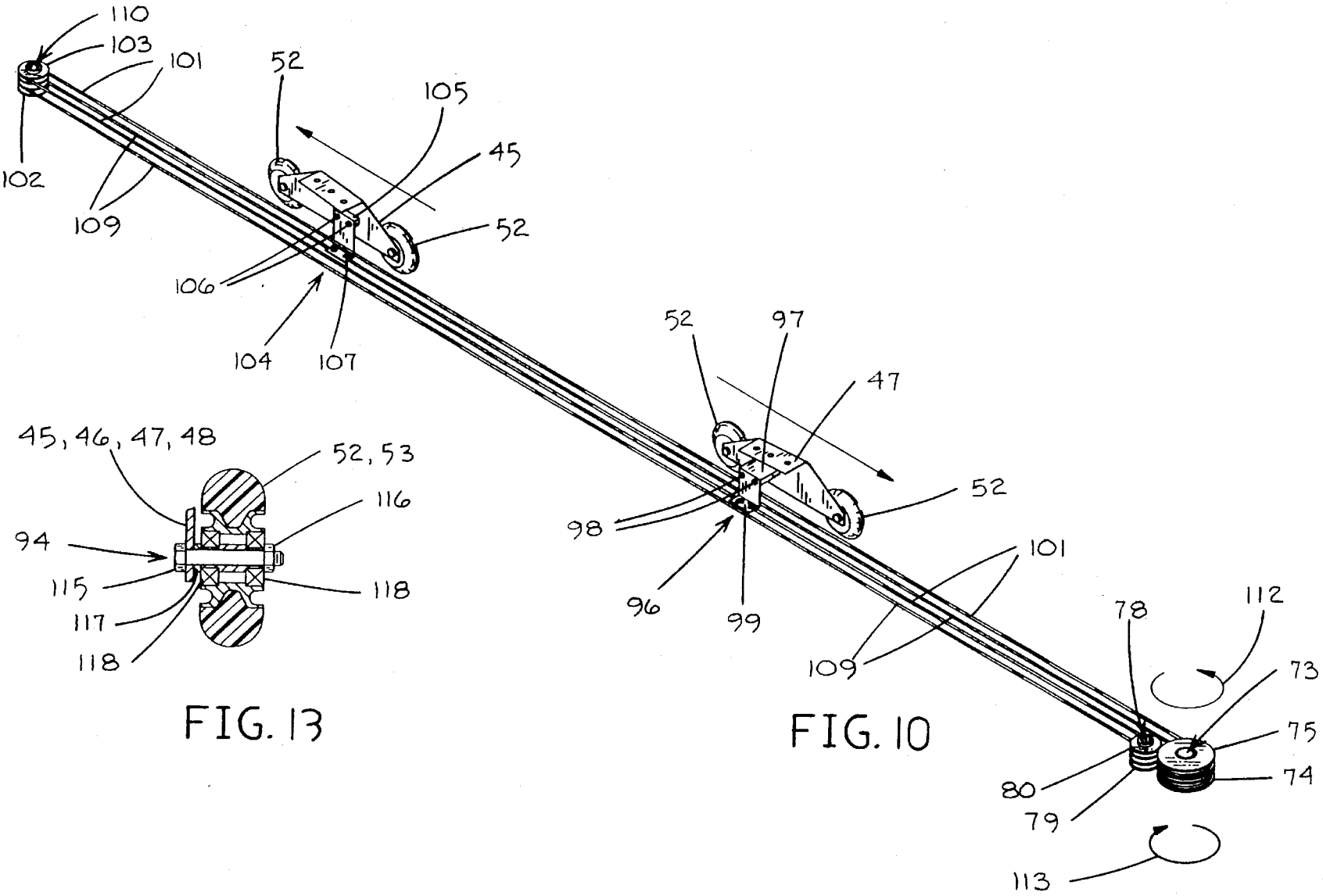
FIG. 10 is perspective view of a portion of the transmission of the exercising apparatus of FIG. 1.
FIG. 13 is a cross-sectional view of the tire taken through line 13—13 of FIG. 11.
Figure 11:
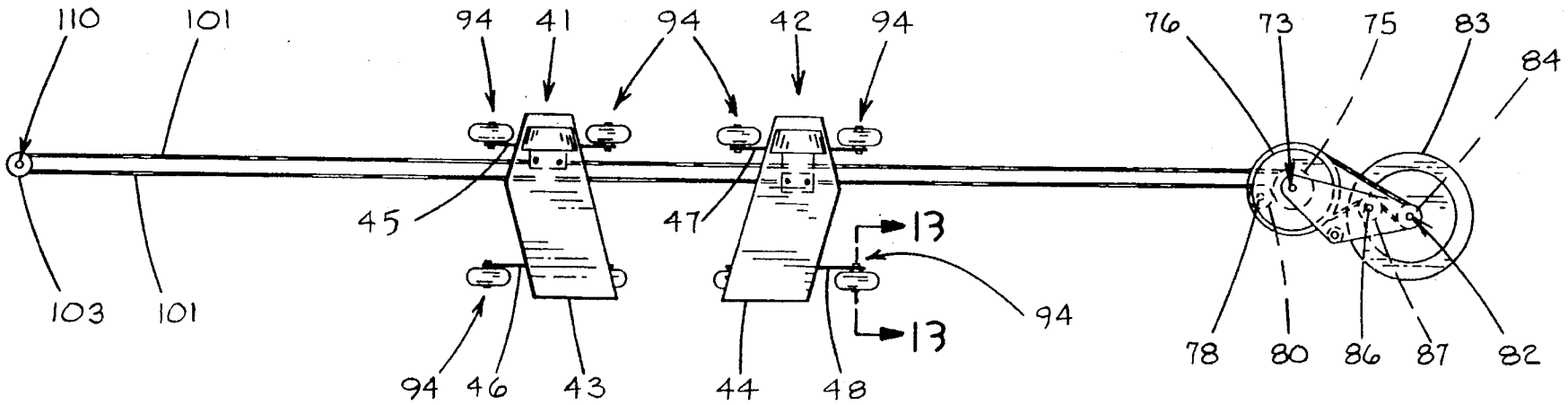
FIG. 11 is a plan view of FIG. 10 showing additional portions of the transmission.
Figure 12:
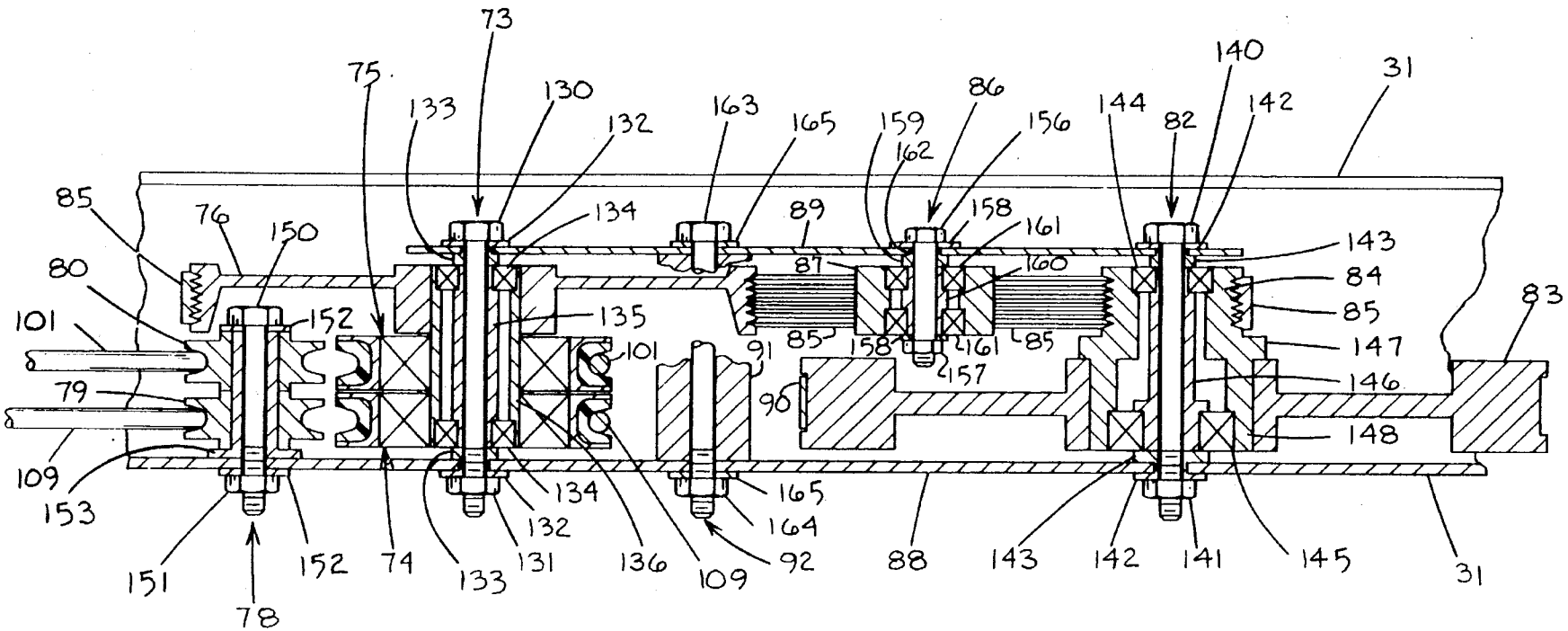
FIG. 12 is an enlarge detailed cross-sectional view taken through line 12—12 of FIG. 7.

FIGS. 7, 10, 11 and 12 shows a shaft means 73 containing mounted unilaterally acting first and second pulley/clutches 74 and 75, and driver pulley 76, shaft means 78 containing mounted idler pulleys 79 and 80, shaft means 82 containing mounted flywheel 83 and driven flywheel pulley 84, and shaft means 86 containing mounted idler pulley 87. Referring to FIGS. 7, 11 and 12, a continuous V-belt connects flywheel 83 to drive pulley 76 and tension on belt 85 is maintained by idler pulley 87. Resistance to the rotation of flywheel 83 is provided by friction belt 90 which attached a one end to anchor 93, deployed partly around the outside diameter of flywheel 83, and tensioned at the other end by threaded screw 81 which is screwed through right end plate 34 thereby providing tensioning means.

Shaft means 73, 78, 82 and 86 are mounted to the bottom portion 88 of outer housing 31 and to support member 89. Support member 89 is spaced away from, and secured to, the bottom portion 88 of outer housing 31 by post 91 and fastener means 92.

As seen in FIGS. 6, 11 and 13, the lower part of wheel brackets 45, 46, 47 and 48 contain axle means 94, having wheels 52 and 53 rotatably secured thereto. Wheels 52 and 53 are supported by, and ride on, front and rear tracks 54 and 55, respectively. The front and rear upper lip portions 36 and 37 of outer housing 31 are preferably close enough to the top of wheels 52 and 53 to prevent their derailing from the track.

As seen in FIGS. 6, 10, and 11, a bracket assembly 96 is attached to the front wheel bracket 47. Bracket assembly 96 is for the right carriage means 42 and consist of extension member 97 secured to wheel bracket 47 by fastener means 98 which also serves to secure short L-member 99 to member 97. A cord 101, preferably having a low stretch character, serves as transmission means, is attached to short L-member 99. Cord 101, as seen in FIGS. 10 and 11, forms a closed loop in the drive rotational direction from short L-member 99, to the idler pulley 80, to pulley/clutch 75, to idler pulley 103, and back to the short L-member 99.

Another bracket assembly 104, shown in FIG. 10, secured to the left carriage means 41 consists of extension member 105 secured to wheel bracket 45 by fastener means 106 which also serves to secure long L-member 107 to member 105. Another low stretch cord 109, which also serves as transmission means, is attached to long L-member 107. In a similar manner as cord 101, cord 109 forms a closed loop in the drive rotational direction from long L-member 107, to idler pulleys 102 and 79, to pulley/clutch 74 and back to long L-member 107. Idler pulleys 102 and 103 are rotatably mounted on shaft means 110 which is secured to a bottom portion of outer housing 31 in a manner similar to that shown in FIG. 12 for idler pulleys 79 and 80. The loop formed by cord 101 lies above the loop formed by cord 109 so that the two cords do not interfere with each other. Accordingly, in FIG. 11 only cord 101 is seen since cord 109 lies directly under cord 101.

Referring to FIGS. 10 and 11, as the left carriage means 41 moves to the left distal end 70 of the track, cord 109 drives pulley/clutch 74 in a drive rotational direction 112, and as the left carriage means 41 moves to the right distal end 71 of the track, cord 109 drives pulley/clutch 74 in a idle rotational direction 113 and pulley/clutch 74 overruns shaft means 73.

Similarly, as the right carriage means 42 moves to the right distal end 71 of the track, cord 101 drives pulley/clutch 75 in the drive rotational direction 112, and as the right carriage means 42 moves to the left distal end 70 of the track, cord 101 drives pulley/clutch 75 in a idle rotational direction 113 and pulley/clutch 75 overruns shaft means 73.

It is to be understood that the several fastener means, bolts and screws mentioned herein pass through holes drilled through the members to be connected or joined to each other, and that the several PEM nuts mentioned herein are pressed into holes drilled therefor in the several components shown in the figures. Such holes are not denoted with element numbers since one skilled in the art will not require such details, however, such holes are shown in the figures where to do so does not unnecessarily add undue clutter to the figures.

Outer housing 31 preferably is formed from 0.125 inch thick aluminum 5052-H32. End plates 33 and 34 preferably are from 0.125 inch thick aluminum 6061-T6. Top plate 32 preferably is made of 0.125 inch thick aluminum 6061-T-6, or 0.125 inch thick fiberglass. U-braces 61 preferably are formed from 11 gage (0.119 inch thickness) steel.

Foot platforms 43 and 44 preferably are made of 0.75 inch thick oak. Toe straps 49 preferably are made of three ply nylon rubber. Wheel brackets 45, 46, 47 and 48 preferably are made of 10 gage (0.134 inch thickness) steel. Fastener means 50 preferably are no. 14 WWD screws, with three per wheel bracket as shown best in FIG. 4. Fastener means 62 preferably are no. 10-32 UNF button head screws with PEM nuts pressed into U-brace 61 and bottom part of outer housing 31, as shown best in FIG. 6, with four per U-brace 61. Short and long L-members 99 and 107 preferably are 14 gage (0.074 inch) steel. Fastener means 98 and 106 preferably are No. 10-24 hex head bolts.

Each axle means 94 preferably consists of a Grade 5, ¼-28 inch UNF hex head bolt 115 and nut 116 therefor, a 0.10 inch steel washer 117, bearings 118 and spacer 114, shown best in FIG. 13.

In FIG. 13, wheels 52 and 53 have an outer tire member 170 preferably are made of a resilient material such as 78-82A urethane. Examples of such wheel are Krypto brand wheels made by Kryptonics, Inc.

Tracks 54 and 55 preferably are made aluminum 6063-T5. Carriage stops 68 and 69, located at the left and right distal ends 70 and 71 of the track, preferably made of 0.5 inch thick aluminum 6063-T5, are attached to bottom part of outer housing 31 by ¼-20 button head bolts 72, two per stop, shown best in FIGS. 8 and 9.

Shaft means 73 preferably consists of bolt 130 and nut 131 therefor, washers 132, aluminum spacers 133, two 38 KPP Fafnir roller bearings 134 separate by aluminum elongated annular member 135, and hollow rotatable member 136, shown best in FIG. 12. Driver pulley 76 and pulley/clutches 75 and 74 are mounted on member 136.

Shaft means 82 preferably consists of bolt 140 and nut 141 therefor, washers 142, aluminum spacers 143, one 38 KPP Fafnir roller bearing 144 and one 202 KPP Fafnir roller bearing 145 separate by aluminum elongated annular member 146 preferably formed from aluminum 6061-T6, and hollow rotatable member 147 preferably formed from aluminum 6061-T6. The upper part of member 147 is driven flywheel pulley 84 and the lower part 148 of member 147 is a hub adapted to receive press fitted thereto flywheel 83.

Idler pulleys 79, 80, 102 and 103 preferably are conventional Nylatron idlers. Shaft means 78 preferably consists of bolt 150 and nut 151 therefor, washers 152 separated by a 0.5 inch diameter hollow idler stud 153 with shoulder at base thereof. Idler pulleys 79 and 80 are mounted onto stud 153 and maintained in place by the stud shoulder and washer 152. Shaft means 110 is similar to shaft means 78 and therefore is not shown in cross-section in the figures.

Shaft means 86 preferably consists of bolt 156 and nut 157 therefor, washers 158, and spacer 159 separated from lower washer 158 by an aluminum elongated annular member 160 which is adapted for mounting in a spaced apart relationship two 38 KPP Fafnir roller bearings 161. Idler pulley 87 is mounted over bearings 161. Idler pulley belt 87 preferably is either a Poly-V J drive belt tension and provide means for taking up any belt slack. Idler pulley 87 also increases the degrees of belt wrap around driven flywheel pulley 84, thereby increasing the drive capacity. Bolt 156 of shaft means 86 passes through a slot 162 in support member 89 thereby providing means for tensioning and taking up slack in V-belt 85.

Fastener means 92 consists of bolt 163 and nut 164 therefor, and washers 165.

The bolt of shaft means 110 and the bolts 130, 142, 150, 156 and 165 preferably are ¼-20 inch UNC hex head bolts. Spacers 133, 143, 152 and 159 preferably are made of aluminum 6061-T6.

The bolt of shaft means 110 and the bolt 150 are secured to the bottom of outer housing 31. Bolts 130, 140 and 163 are secured to support member 89 and the bottom of outer housing 31, and bolt 156 is secured to support member 89.

Left end plate 33 preferably is secured to left carriage stops 68 by No. 10-32 UNF button head screws 166.

At the right side of the exercising apparatus, L-member 167 is secured to the bottom inside surface of outer housing 31 by No. 10-32 UNF button head screws 168, and right end plate 34 preferably is secured to L-members 167 by No. 10-32 UNF button head screws 169.

Cords 101 and 109 preferably are 7/32 inch diameter dacron, low stretch, durable braided construction.

Figure 14:
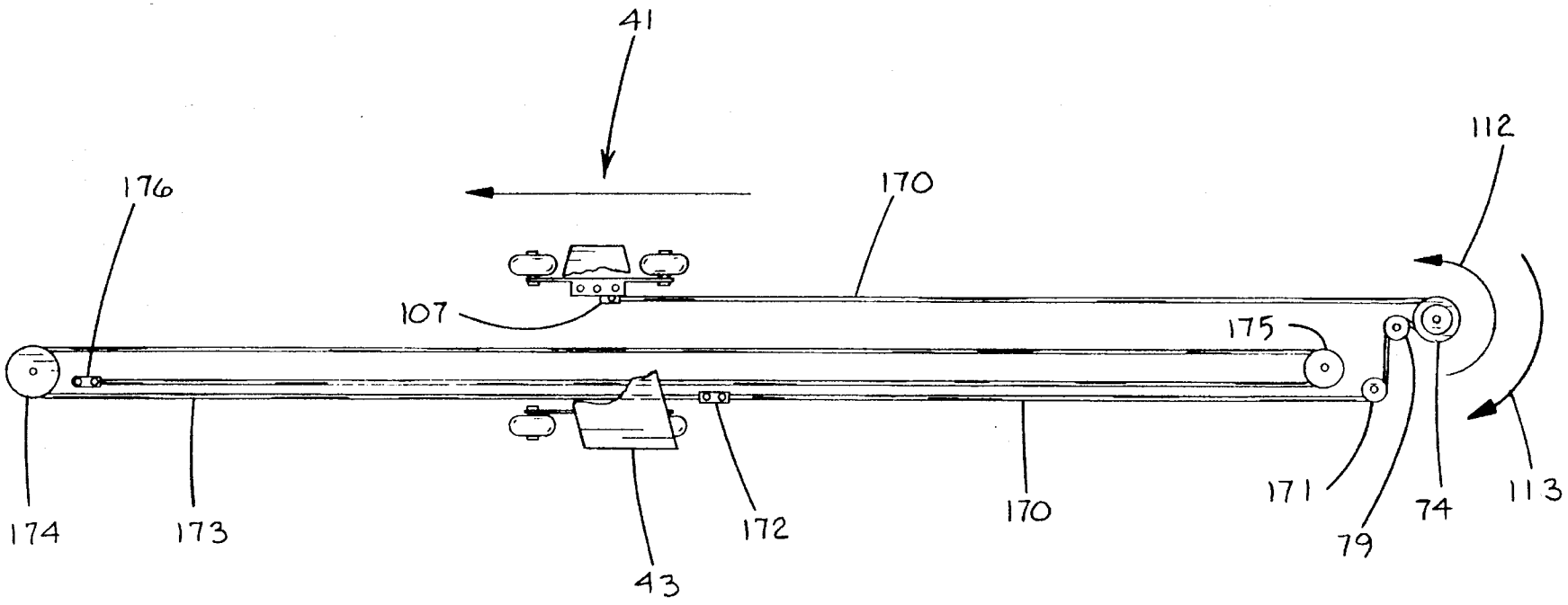
FIG. 14 is a detail of another embodiment of the exercising apparatus of FIG. 1 showing assisted return of the left carriage.
Figure 15:
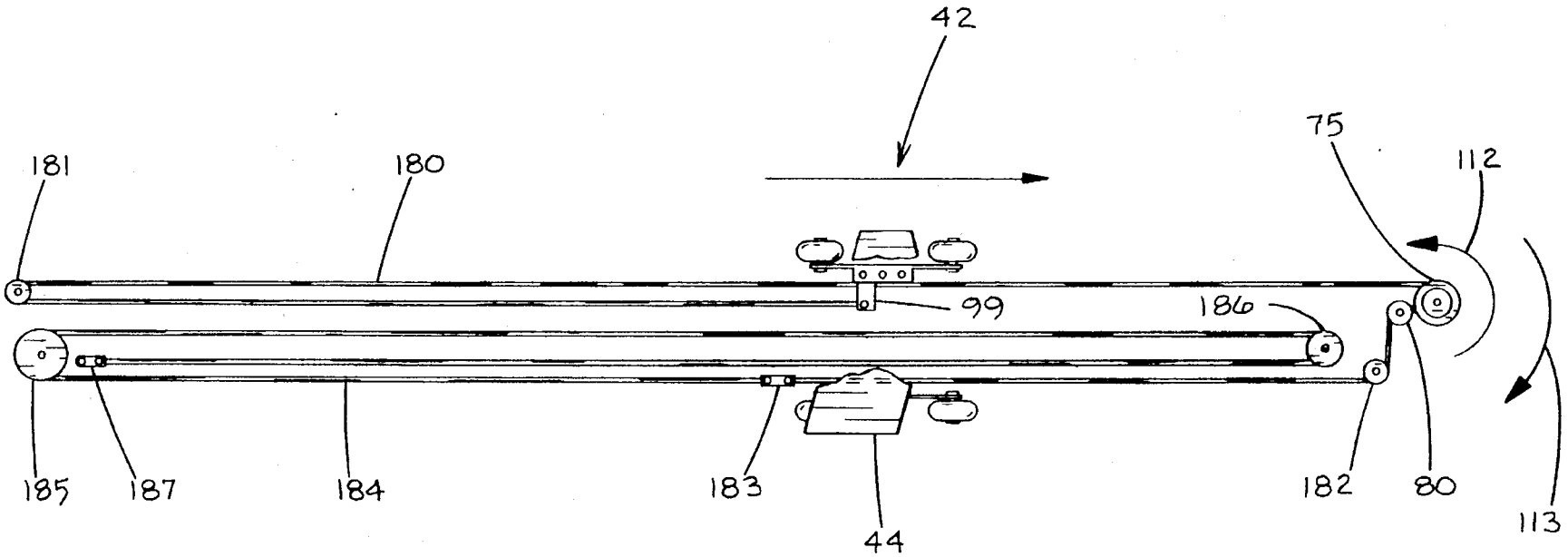
FIG. 15 is a detail of the other embodiment of the exercising apparatus of FIG. 1 showing assisted return of the right carriage.

In a further embodiment, the left carriage means 41 has assisted travel as it moves towards the right distal end 71 of the track, and the right carriage means 42 has assisted travel as it moves towards the left distal end 70 of the track, has illustrated in FIGS. 14 and 15, respectively.

With regard to the assisted return of the left carriage means 41 shown in FIG. 14, cord 109 has been replaced with low stretch or drive cord 170. One end of drive cord 170 is attached to long L-member 107 and then engages (proceeding in the idle rotational direction 113) pulley/clutch 74, then idler pulleys 79 and 171, and terminates with the other end of drive cord 170 and 171, and terminates with the other end of drive cord 170 attached to traveling coupler 172. To assist in the movement of left carriage means 41 toward right distal end 71 of the track, one end of an elastic cord 173 is attached to traveling coupler 172 and then engages (proceeding in the idle rotational direction 113) idler pulleys 174 and 175, and terminates with the other end of elastic cord 173 attached to non-moving or fixed coupler 176. Thus in this embodiment, elastic cord 173 always exerts a small force on the left carriage means 41 to move it towards right distal end 71 of the track.

With regard to the assisted return of the right carriage means shown in FIG. 15, cord 101 has been replaced with low stretch or drive cord 180. One end of drive cord 180 is attached to short L-member 99 and then engages (proceeding in the idle rotational direction 113) idler pulley 181, pulley/clutch 75, then idler pulleys 80 and 182, and terminates with the other end of drive cord attached to traveling coupler 183. To assist in the movement of right carriage means 42 toward left distal end 70 of the track, one end an elastic cord 184 is attached to traveling coupler 183 and then engages (proceeding in the idle rotational direction 113) idler pulleys 185 and 186, and terminates with the other end of elastic cord 184 attached to non-moving or fixed coupler 187. Thus in this embodiment, elastic cord 184 always exerts a small force on the right carriage means 42 to move it towards left distal end 70 of the track.

In the previously described embodiment, shown in part by FIG. 10, the first and second engaging means or pulley/clutches 74 and 75 are on a common shaft means 78, which remains in a fixed location relative to the track, and the transmission means comprises, in part, cords 101 and 109.

In another embodiment, however, illustrated in FIGS. 16 to 19 and 24, the first and second engaging means 200 and 201 reside on separate shaft means and travel with the left and right carriage means 202 and 203, respectively, and drive or overrun the transmission means. In this embodiment, unilaterally acting first and second pulley/clutches 204 and 205 drive or overrun continuous belt 206 which, in part, provides means for transmission. The inside surface 207 of belt 206 contains uniformly spaced teeth 208 for engaging corresponding teeth in first and second pulley/clutches 204 and 205. Idler pulleys 210 and 211, which also travel with the left and right carriage means, respectively, provide means for tensioning belt 206, means for taking up any belt slack, and means for increasing the degrees of belt wrap around first and second pulley/clutches 204 and 205 thereby increasing the drive capacity. Belt 206 also engages idler pulley 212 located near the left distal end 70 of the track, and rotatable member 213 located near the right distal end 71 of the track.

Figures 16, 17, 18:
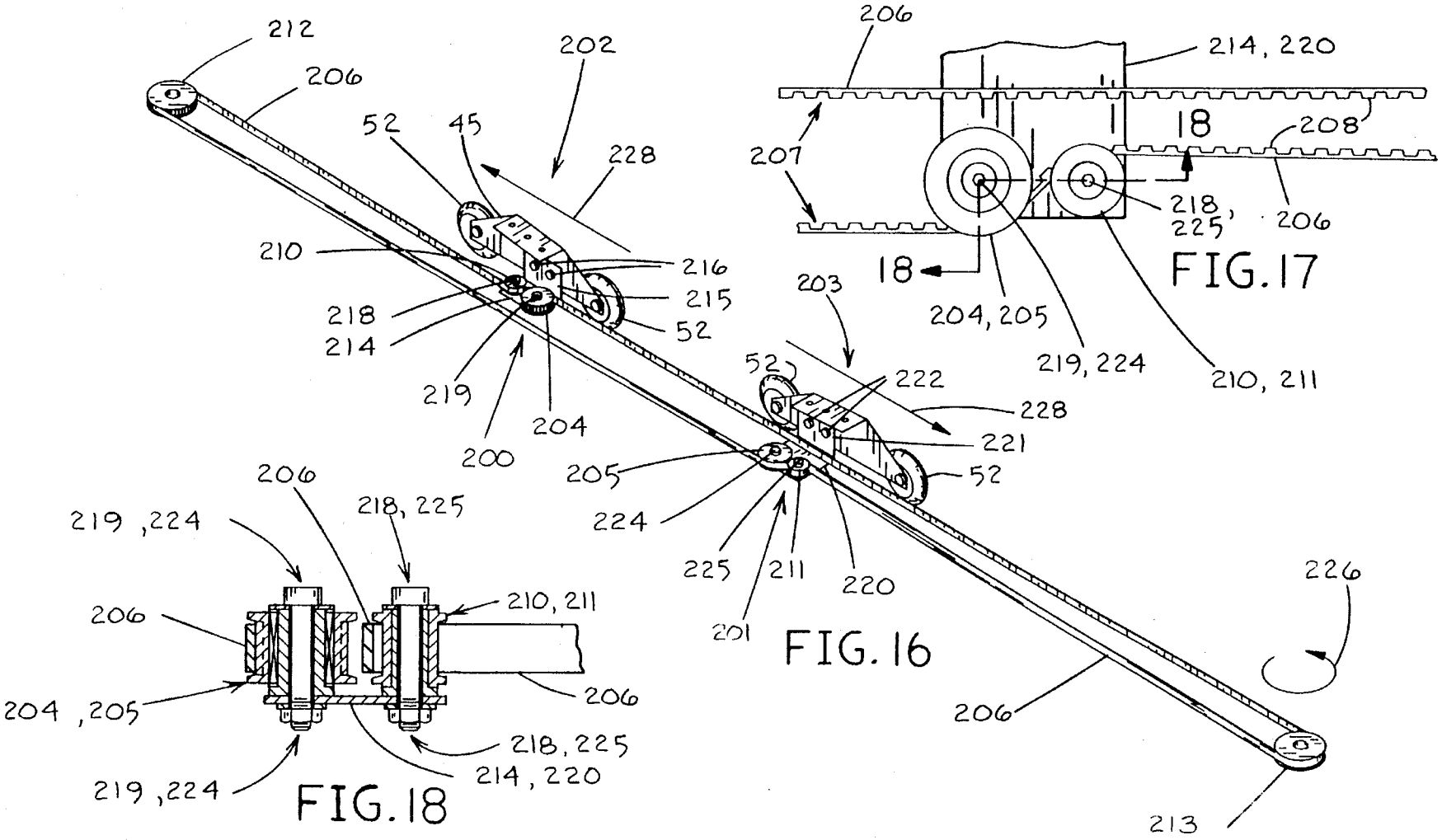
FIG. 16 is perspective view of a portion of the transmission of still another embodiment of this invention.
FIG. 17 is a detail of the embodiment of FIG. 16 showing the relationship of one-way clutch and idler pulley to the continuous belt.
FIG. 18 is an elevational detail in cross-section taken through line 18—18 of FIG. 17.

FIGS. 17 and 18 illustration further details of the embodiment of this invention shown in FIG. 16. Attached to wheel bracket 45 of left carriage means 202 is a L-shaped member having a horizontally depending portion 214 and a vertically depending portion 215, the latter of which is attached to wheel bracket 45 by fastener means 216. Horizontally depending portion 214 contains vertically extending shaft means 218 and 219 on which are rotatably mounted idler pulley 210 and pulley/clutch 204, respectively.

Attached to wheel bracket 47 of right carriage means 203 is a L-shaped member having a horizontally depending portion 220 and a vertically depending portion 221, the latter of which is attached to wheel bracket 47 by fastener means 222. Horizontally depending portion 220 contains vertically extending shaft means 224 and 225 on which are rotatably mounted pulley/clutch 205 and idler pulley 211, respectively.

Figure 24:
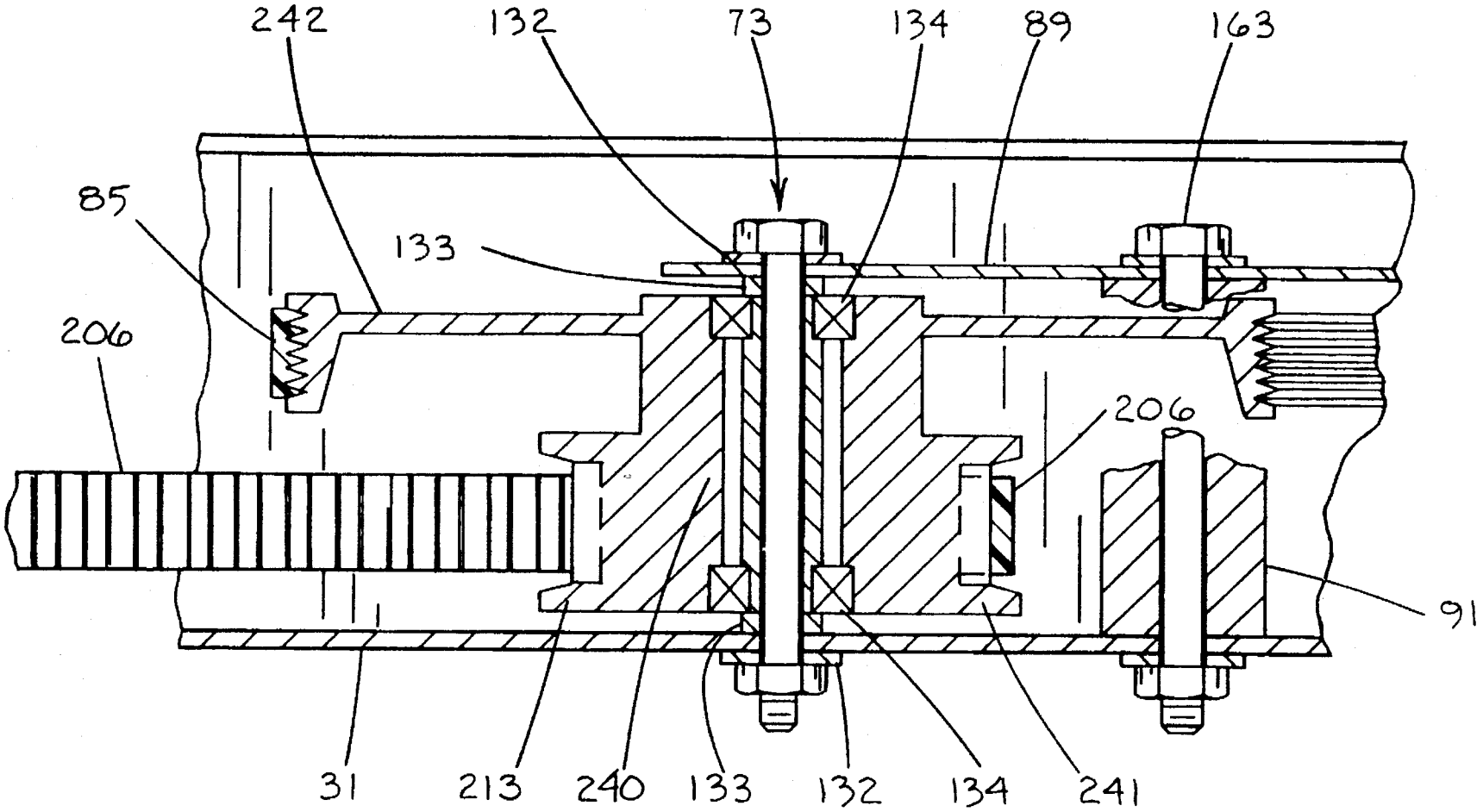
FIG. 24 is an enlarge detailed cross-sectional view taken through line 24—24 of FIG. 19

In operation, as left carriage means 202 moves towards left distal end 70 of the track, pulley/clutch 204 locks against rotation and its teeth engage teeth 208 of belt 206, so that belt 206 is driven around idler pulley 212, overruns pulley/clutch 205 thereby not contributing to the movement of right carriage means 203, proceeds around idler pulley 211, and drives driven pulley portion 241 in drive rotational direction 226 as shown in FIGS. 16 and 24. Similarly, as right carriage means 203 moves towards right distal end 71 of the track, pulley/clutch 205 locks against rotation and its teeth engage teeth 208 of belt 206, so that belt 206 drives driven pulley portion 241 in drive rotational direction 226, overruns pulley/clutch 204 thereby not contributing to the movement of left carriage means 202, and proceeds around idler pulleys 214 and 212. Therefore it can be seen that unilaterally acting pulley/clutch 204 engages and locks onto belt 206 when left carriage means 202 moves towards the left distal end 70 of the track, and that unilaterally acting pulley/clutch 205 engages and locks onto belt 206 when right carriage means 202 moves towards the right distal end 71 of the track. It can also be seen that pulley/clutch 204 overruns and does not lock onto belt 206 when left carriage means 202 moves towards the right distal end 71 of the track, and that pulley/clutch 205 overruns and does not lock onto belt 206 when right carriage means 202 moves towards the left distal end 70 of the track. This feature can also be accomplished by a paw mechanism which bits into the belt 206 when the carriage means move outward, i.e. the direction of arrows and drags over the belt when the carriage means moves inward.

Figure 19:
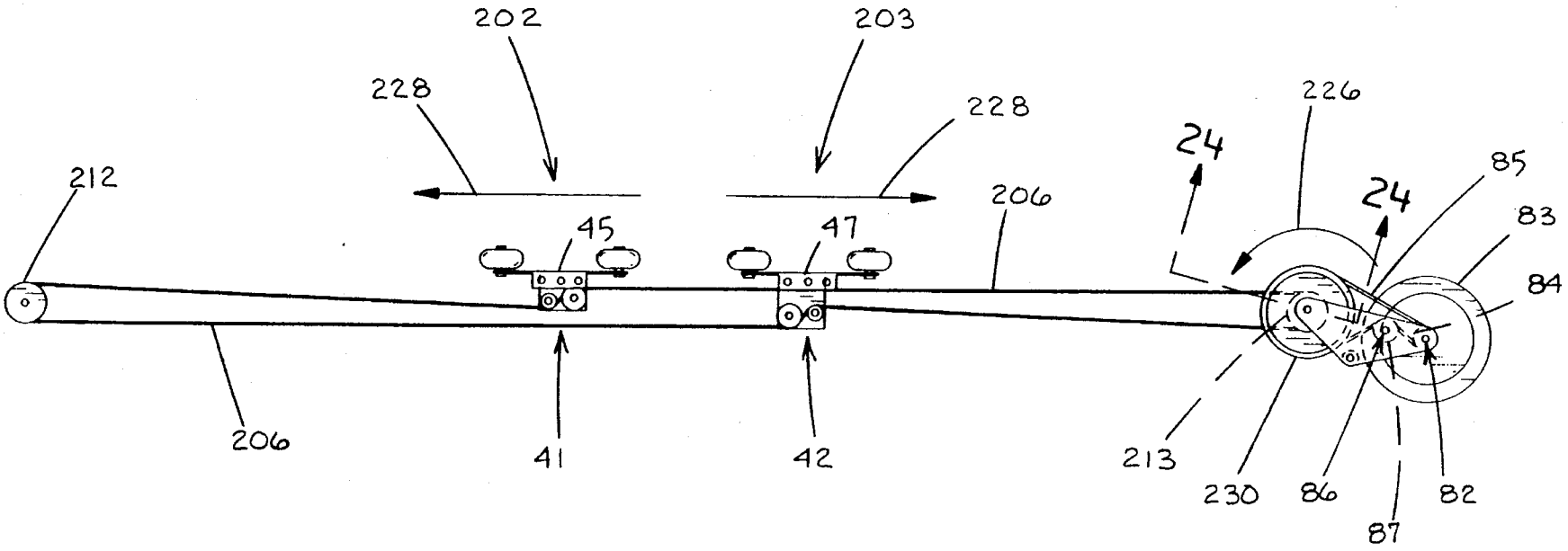
FIG. 19 is a plan view of FIG. 18 showing additional portions of the transmission.

FIGS. 19 and 24 illustrate how rotation of the rotatable member 213 of this embodiment is transmitted to flywheel 83 and is similar in some aspects to FIGS. 11 and 12. In this embodiment, portion 240 serves as the same function as hollow rotatable member 136 of FIG. 12, portion 241 of member 213 serves as driven pulley replacing pulley/clutches 74 and 75 of FIG. 12, and portion 242 serves as second and larger diameter driver pulley similar to pulley 76 of FIG. 12. Belt 85 is connected to and drives flywheel 83 in the same manner as described for FIG. 12 with idler pulley 87 providing tensioning means for belt 85.

Figure 20:
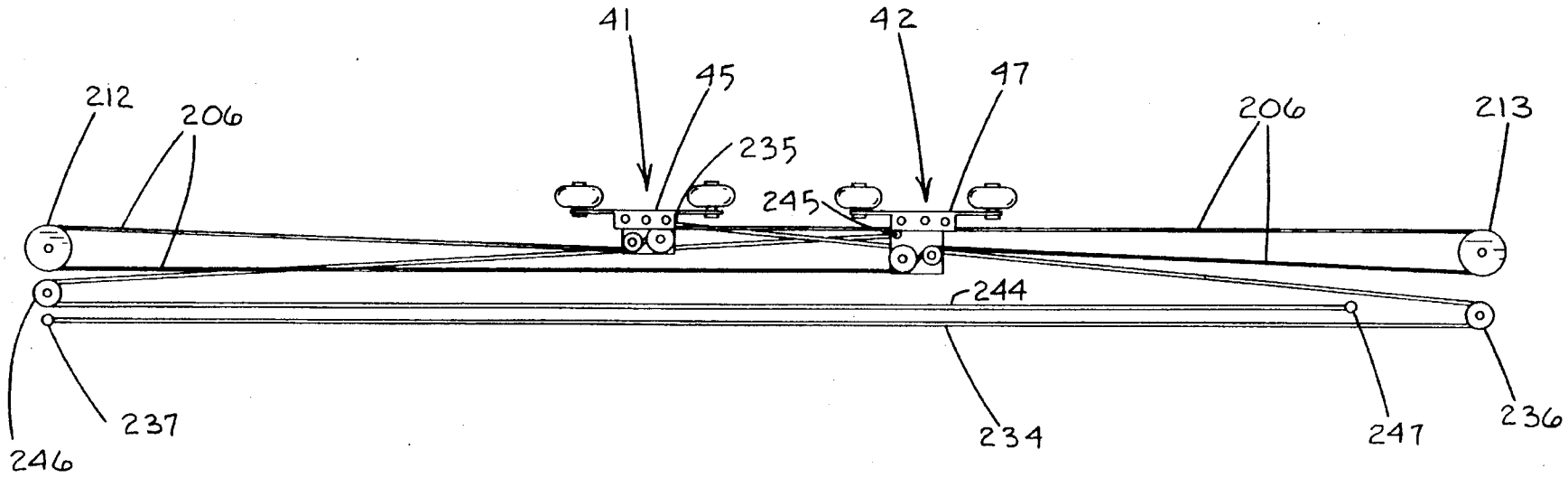
FIG. 20 is a detail of further embodiment of the transmission of FIG. 19 showing assisted return of the carriages.

FIG. 20 illustrates a further embodiment of the exercising apparatus of FIGS. 16–19, in which the left carriage means 41 has assisted travel as it moves towards the right distal end 71 of the track, and the right carriage means 42 has assisted travel as it moves towards the left distal end 70 of the track.

To assist in the return of the left carriage means 41, one end 235 of an elastic cord 234 is attached to wheel bracket 45, and with the left carriage means 41 at the mid-point of the track, elastic cord 234 is pulled taut over idler pulley 236 and the other end of cord 234 fasten to post 237. Thus elastic cord 234 always exerts a small inward force on the left carriage means 41, as it is moved outward from the track mid-point, to move the left carriage means back towards right distal end 71 of the track.

To assist in the return of the right carriage means 42, one end 245 of another elastic cord 244 is attached to wheel bracket 47, and with the right carriage means 42 at the mid-point of the track, elastic cord 244 pulled taut over idler pulley 246 and the other end of cord 244 fasten to post 247. Thus elastic cord 244 always exerts a small inward force on the right carriage means 42, as it is moved outward from the track mid-point, to move right carriage means back towards left distal end 70 of the track.

Since the shaft means for the several pulleys of the embodiment of FIGS. 16–20 are eight identical or similar to those of FIGS. 1–15, a detail description is not necessary to one skilled in the art. The shaft means of pulleys 212, 236 and 246 are attached to the inside surface of outer housing 31. Shaft means 218, 219, 224 and 225 preferably comprise hex head ¼-20 bolts.

Pulley/clutches 204 and 205 are one-way clutches such as Torrington RCB-121616 brand clutches. Idler pulleys 210 and 211 preferably are Nylatron idlers. L-members 214, 215, 220 and 221 preferably are 11 gage (0.119 inch) steel.

Figure 21:
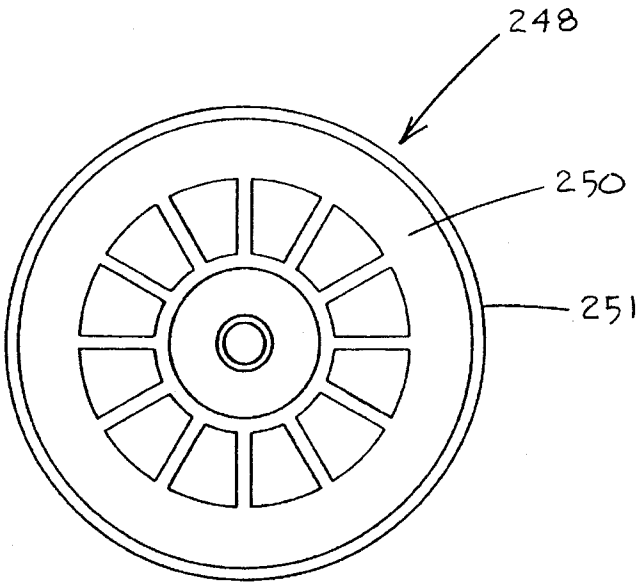
FIG. 21 is an elevational view of another wheel.
Figure 23:
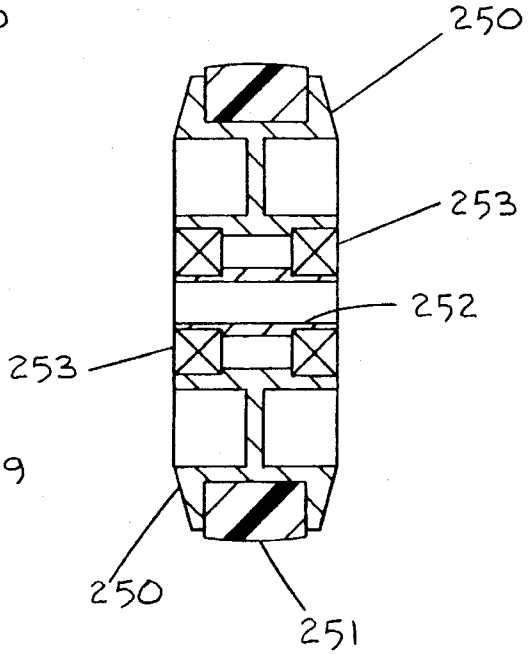
FIG. 23 is an elevational view in cross section taken through line 23—23 of FIG. 22.
Figure 22:
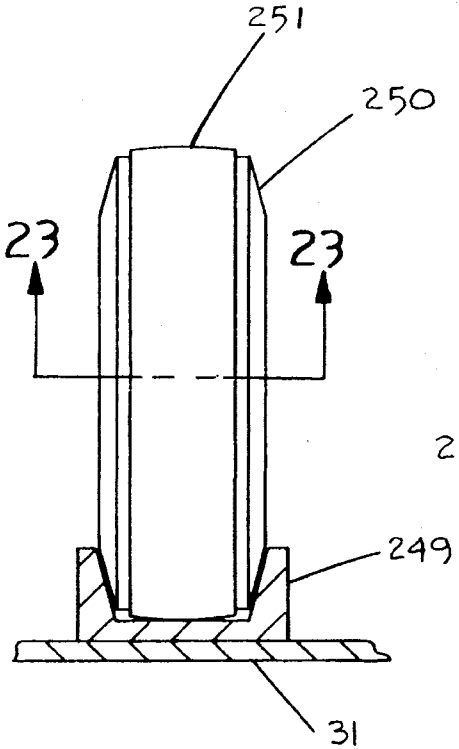
FIG. 22 is cross-sectional view of the wheel of FIG. 21 set in a track of another embodiment.

In another embodiment, wheels 52 and 53 and tracks 54 and 55 are preferably replaced with the wheel 248 and track 249 illustrated in FIGS. 21–23. Round wheels sometimes have a tendency to try and climb the side of a track if significant side force is applied to the carriage means. This tendency is due to the high coefficient of friction of urethane tires. A more preferred embodiment has a low coefficient of friction plastic material 250 in the tire side and a rubber or urethane insert 251 which comprises the outside diameter of the tire. Example of material 250 are Delrin or Nylatron brand plastic materials. Insert 251 material preferably is 80A urethane. Wheel 248 preferably has a hollow aluminum hub 252 for receiving axle means 94 and two 38PP Fafnir sealed ball bearings 253.

While the preferred embodiments of the present invention have been described, it should be understood that various changes, adaptations and modifications may be made thereto without departing from the spirit of the invention and the scope of the appended claims. It should be understood, therefore, that the invention is not to be limited to minor details of the illustrated invention shown in preferred embodiment and the figures, and that variations in such minor details will be apparent to one skilled in the art.

Therefore it is to be understood that the present disclosure and embodiments of this invention described herein are for purposes of illustration and example and that modifications and improvements may be made thereto without departing from the spirit of the invention or from the scope of the claims. The claims, therefore, are to be accorded a range of equivalents commensurate in scope with the advances made over the art.

What is claimed is:

1. An exercising apparatus in which outward and approximately opposite unilateral movement of the user's feet drives driven means in a drive direction, the exercising apparatus comprising:

base means for supporting track means, the track means having left and right distal ends;

left carriage means and right carriage means, the track means for restraining the left and the right carriage means to approximately horizontal movement, the left and right carriage means operable for supporting user's left foot and right foot, respectively, so that when the user's left foot extends outwardly and to the left of user's body the left carriage means moves towards the left distal end of the track means, and when the user's right foot extends outwardly and to the right of user's body the right carriage means moves towards the right distal end of the track means;

driven means supported by the base means, the driven means for driving resistance means;

first means having unilaterally acting first engaging means and first transmission means, the first means operable for effecting the driving of the driven means in a drive direction when the left carriage means moves towards the left distal end and not driving the driven means when the left carriage means moves towards the right distal end, the first transmission means including a first flexible member with first and second ends which are connected to the left carriage means;

second means having unilaterally acting second engaging means and second transmission means, the second means operable for effecting the driving of the driven means in the drive direction when the right carriage means moves towards the right distal end and not driving the driven means when the right carriage means moves towards the left distal end, the second transmission means including a second flexible member with first and second ends which are connected to the right carriage means; and the resistance means for resisting outward movement of the left and right carriage means.

2. The exercising apparatus of claim 1, wherein the track means is operable for preventing the left and right carriage means from passing each other so that the left carriage means is always to the left of the right carriage means.

3. The exercising apparatus of claim 2, wherein the left carriage means has a left and right side, wherein the right carriage means has a left and right side, and wherein the left side of the right carriage means can touch the right side of the left carriage means as the left and right carriage means moves on the track means.

4. The exercising apparatus of claim 1, wherein the left and right carriage means are also operable for positioning the user's feet approximately horizontal and approximately perpendicular to the track means.

5. The exercising apparatus of claim 1, further comprising means for assisting in the return of the left carriage means to the right distal end, and means for assisting in the return of the right carriage means to the left distal end.

6. The exercising apparatus of claim 1, wherein the driven means comprises a pulley.

7. The exercising apparatus of claim 1, wherein the driven means comprises common shaft means upon which the first and second engaging means are mounted.

8. The exercising apparatus of claim 1, wherein the left carriage means drives a first flexible member which drives the first engaging means which drives the driven means, and wherein the right carriage means drives a second flexible member which drives the second engaging means which drives the driven means.

9. The exercising apparatus of claim 1, wherein the first and second engaging means are mounted on shaft means which is supported by the base means.

10. An exercising apparatus in which outward and approximately opposite unilateral movement of the user's feet drives driven means in a drive direction, the exercising apparatus comprising:

base means for supporting track means, the track means having left and right distal ends;

left carriage means and right carriage means, the track means for restraining the left and the right carriage means to approximately horizontal movement, the left and right carriage means operable for supporting user's left foot and right foot, respectively, so that when the user's left foot extends outwardly and to the left of user's body the left carriage means moves towards the left distal end of the track means, and when the user's right foot extends outwardly and to the right of user's body the right carriage means moves towards the right distal end of the track means;

driven means supported by the base means, the driven means for driving resistance means;

first means having unilaterally acting first engaging means and first transmission means which including a flexible member, the first means operable for effecting the driving of the driven means in a drive direction when the left carriage means moves towards the left distal end and not driving the driven means when the left carriage means moves towards the right distal end;

second means having unilaterally acting second engaging means and second transmission means which includes the second means operable for effecting the driving of the driven means in the drive direction when the right carriage means moves towards the right distal end and not driving the driven means when the right carriage means moves towards the left distal end; and the resistance means for resisting outward movement of the left and right carriage means.

11. The exercising apparatus of claim 10, wherein the first engaging means is supported by the left carriage means and the second engaging means is supported by the right carriage means, and wherein the first and second engaging means drive the flexible member which drives the driven means.

12. The exercising apparatus of claim 11, wherein the first and second engaging means each comprise a pulley/clutch having a gear pulley, and wherein the flexible member comprises teeth adapted for meshing with the gear pulleys.

13. An exercising apparatus in which outward and approximately opposite unilateral movement of the user's feet drives driven means in a drive rotational direction, the exercising apparatus comprising:

base means for supporting track means, the track means having left and right distal ends;

left carriage means and right carriage means, the track means for restraining the left and the right carriage means to approximately horizontal movement, the left and right carriage means operable for supporting user's left foot and right foot, respectively, so that when the user's left foot extends outwardly and to the left of user's body the left carriage means moves towards the left distal end of the track means, and when the user's right foot extends outwardly and to the right of user's body the right carriage means moves towards the right distal end of the track means;

driven means rotatably supported by the base means, the driven means for driving resistance means;

unilaterally acting first engaging means having a drive rotational direction and an opposite, idle rotational direction, the first engaging means for i. driving the driven means in a drive rotational direction when the first engaging means moves in its drive rotational direction, and ii. overrunning the driven means when the first engaging means moves in its idle rotational direction;

first transmission means which includes a first flexible transmission means with first and second ends connected to the left carriage means, the first transmission means for rotating the first engaging means in its drive rotational direction when the left carriage means moves towards the left distal end;

unilaterally acting second engaging means having a drive rotational direction and an opposite, idle rotational direction, the second engaging means for i. driving the driven means in its drive rotational direction when the second engaging means moves in its drive rotational direction, and ii. overrunning the driven means when the second engaging means moves in its idle rotational direction;

second transmission means which includes a second flexible transmission means with first and second ends connected to the right carriage means, the second transmission means for rotating the second engaging means in its drive rotational direction when the right carriage means moves towards the right distal end; and the resistance means for resisting outward movement of the left and right carriage means.

14. The exercising apparatus of claim 13, wherein the track means is operable for preventing the left and right carriage means from passing each other so that the left carriage means is always to the left of the right carriage means.

15. The exercising apparatus of claim 14, wherein the left carriage means has a left and right side, wherein the right carriage means has a left and right side, and wherein the left side of the right carriage means can touch the right side of the left carriage means as the left and right carriage means moves on the track means.

16. The exercising apparatus of claim 13, wherein the left and right carriage means is also operable for positioning the user's feet approximately horizontal and approximately perpendicular to the track means.

17. The exercising apparatus of claim 13, wherein the driven means comprises common shaft means upon which the first and second engaging means are mounted.

18. The exercising apparatus of claim 13, wherein the first transmission means comprises a first flexible member and first idler means, the first flexible member forming a linkage between the left carriage means, the first idler means, and the first engaging means, and wherein the second transmission means comprises a second flexible member and second idler means, the second flexible member forming a linkage between the right carriage means, the second idler means, and the second engaging means.

19. The exercising apparatus of claim 13, wherein the resistance means comprises rotational momentum storage means, third flexible transmission means, and braking means, the rotational momentum storage means for storing rotational momentum, the braking means for resisting rotation of the rotational momentum storage means; and the third flexible transmission means forming a continuous loop between the driven means and the rotational momentum storage means so that rotation of the driven means in its drive rotational direction causes rotation of the rotational momentum storage means.

20. The exercising apparatus of claim 13, further comprising means for assisting in the return of the left carriage means to the right distal end, and means for assisting in the return of the right carriage means to the left distal end.

21. An exercising apparatus in which outward and approximately opposite unilateral movement of the user's feet drives driven means in a drive rotational direction, the exercising apparatus comprising:

base means for supporting track means, the track means having left and right distal ends;

left carriage means and right carriage means, the track means for restraining the left and the right carriage means to approximately horizontal movement, the left and right carriage means for supporting user's left foot and right foot, respectively, so that when the user's left foot extends outwardly and to the left of user's body the left carriage means moves towards the left distal end of the track means, and when the user's right foot extends outwardly and to the right of user's body the right carriage means moves towards the right distal end of the track means;

driven means rotatably supported by the base means, the driven means for driving resistance means;

unilaterally acting first engaging means supported by the left carriage means, the first engaging means engaging transmission means when the left carriage means moves towards the left distal end, and overrunning the transmission means when the left carriage means moves towards the right distal end;

unilaterally acting second engaging means supported by the right carriage means, the second engaging means engaging the transmission means when the right carriage means moves towards the right distal end, and overrunning the transmission means when the right carriage means moves towards the left distal end, the transmission means comprising a first flexible member for driving the driven means, the first flexible member forming a continuous loop between the first engaging means, the second engaging means, and the driven means, the first engaging means for i. engaging and driving the first flexible member in a first flexible member drive direction when the left carriage means moves towards the left distal end, and ii. overrunning and not driving the first flexible member when the left carriage means moves toward the right distal end, the second engaging means for i. engaging and driving the first flexible member in the first flexible member drive direction when the right carriage means moves towards the right distal end, and ii. overrunning and not driving the first flexible member when the right carriage means moves toward the left distal end; and the resistance means for resisting outward movement of the left and right carriage means.

22. The exercising apparatus of claim 21, wherein the track means is operable for preventing the left and right carriage means from passing each other so that the left carriage means is always to the left of the right carriage means.

23. The exercising apparatus of claim 22, wherein the left carriage means has a left and right side, wherein the right carriage means has a left and right side, and wherein the left side of the right carriage means can touch the right side of the left carriage means as the left and right carriage means moves on the track means.

24. The exercising apparatus of claim 21, wherein the left and right carriage means is also operable for positioning the user's feet approximately horizontal and approximately perpendicular to the track means.

25. The exercising apparatus of claim 21, wherein the first engaging means comprises a first pulley/clutch mounted on first shaft means which is supported by the left carriage means, and wherein the first pulley/clutch engages the first flexible member by locking onto it, and wherein the second engaging means comprises a second pulley/clutch mounted on second shaft means which is supported by the right carriage means, and wherein the second pulley/clutch engages the first flexible member by locking onto it.

26. The exercising apparatus of claim 21, wherein the first engaging means comprises a first pawl pivotally mounted on and supported by the left carriage means, and wherein the first pawl engages the first flexible member by locking onto it, and wherein the second engaging means comprises a second pawl pivotally mounted on and supported by the right carriage means, and wherein the second pawl engages the first flexible member by locking onto it.

27. The exercising apparatus of claim 21, wherein the resistance means comprises rotational momentum storage means for storing rotational momentum, second flexible transmission means for forming a continuous loop between the driven means and the rotational momentum storage means so that rotation of the driven means in its drive rotational direction causes rotation of the rotational momentum storage means, and braking means for resisting rotation of the rotational momentum storage means.

28. The exercising apparatus of claim 21, further comprising means for assisting in the return of the left carriage means to the right distal end, and means for assisting in the return of the right carriage means to the left distal end.

29. The exercising apparatus of claim 1, wherein the driven means is also the resistance means.

30. The exercising apparatus of claim 13, wherein the driven means is also the resistance means.

31. The exercising apparatus of claim 21, wherein the driven means is also the resistance means.

32. An exercising apparatus in which outward and approximately opposite unilateral movement of the user's feet drives driven means in a drive direction, the exercising apparatus comprising:

track means having left and right distal ends;

left carriage means and right carriage means, the track means for restraining the left and the right carriage means to approximately horizontal movement, the left and right carriage means operable for supporting user's left foot and right foot, respectively, so that when the user's left foot extends outwardly and to the left of user's body the left carriage means moves towards the left distal end of the track means, and when the user's right foot extends outwardly and to the right of user's body the right carriage means moves towards the right distal end of the track means;

driven means supported by the track means, the driven means for driving resistance means;

first means having unilaterally acting first engaging means and first transmission means, the first means operable for effecting the driving of the driven means in a drive direction when the left carriage means moves towards the left distal end and not driving the driven means when the left carriage means moves towards the right distal end, the first transmission means including a first flexible member with first and second ends which are connected to the left carriage means;

second means having unilaterally acting second engaging means and second transmission means, the second means operable for effecting the driving of the driven means in the drive direction when the right carriage means moves towards the right distal end and not driving the driven means when the right carriage means moves towards the left distal end, the second transmission means including a second flexible member with first and second ends which are connected to the right carriage means; and the resistance means for resisting outward movement of the left and right carriage means.

* * * * *